United States Patent [19]

Mar

[11] Patent Number: 4,819,817

[45] Date of Patent: Apr. 11, 1989

[54] ANIMAL TREE

[76] Inventor: Gregg Mar, 3030 Monticello Ln., Chico, Calif. 95926

[21] Appl. No.: 129,590

[22] Filed: Dec. 7, 1987

[51] Int. Cl.[4] ..... A47F 7/00

[52] U.S. Cl. ..... 211/205; 211/86; 211/196

[58] Field of Search ..... 211/86, 205, 196; 248/159; 135/66, 74

[56] References Cited

U.S. PATENT DOCUMENTS

| | | | |
|---|---|---|---|
| Re. 28,067 | 7/1974 | Hyman | 135/74 |
| 1,266,749 | 5/1918 | Abbott | 211/205 X |
| 2,991,040 | 7/1961 | Levy | 211/105.6 X |
| 3,018,898 | 1/1962 | Frazelle | 211/86 |
| 3,820,694 | 6/1974 | Pabis | 211/86 X |
| 3,961,822 | 6/1976 | Daniel | 211/105.6 X |
| 4,101,036 | 7/1978 | Craig | 211/86 |

*Primary Examiner*—Robert W. Gibson, Jr.

[57] ABSTRACT

An adjustable pole type support device structured of three to four tubular sections containing a tension spring ceiling support and a floor base support, the tubular sections being separate pieces or internally connect by hinged retainer cord. The outer surface of the support device has a multiple of hooks designed as an animal tree to support children's stuffed toy animals and dolls. The pole structure is available in a variety of colors. This invention can esily be disassembled into small sections for storage and shipping.

6 Claims, 2 Drawing Sheets

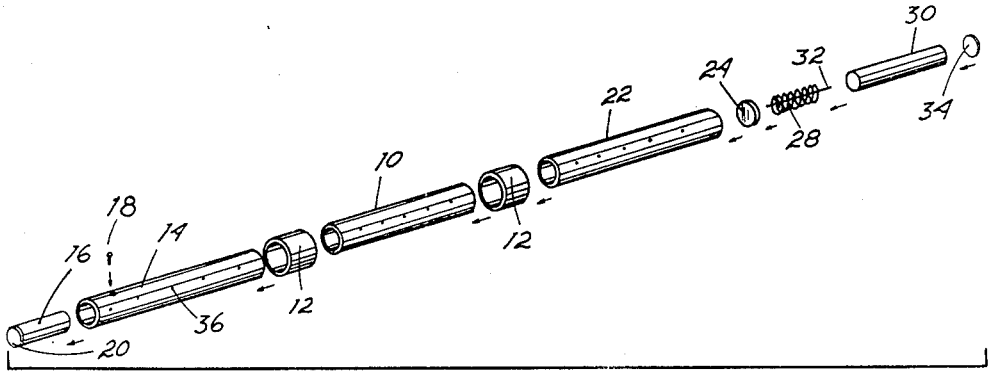
Fig. 1
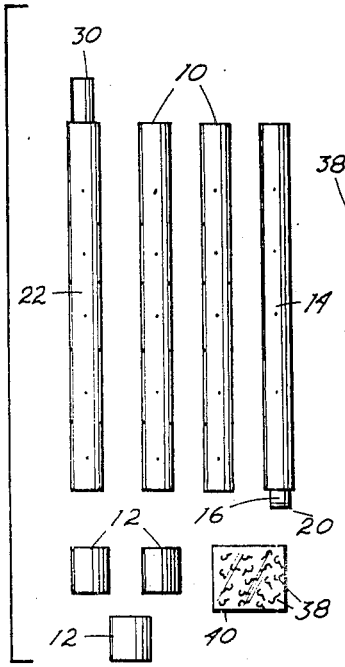
Fig. 2
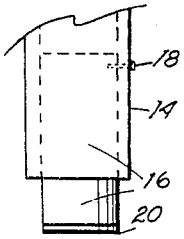
Fig. 3A
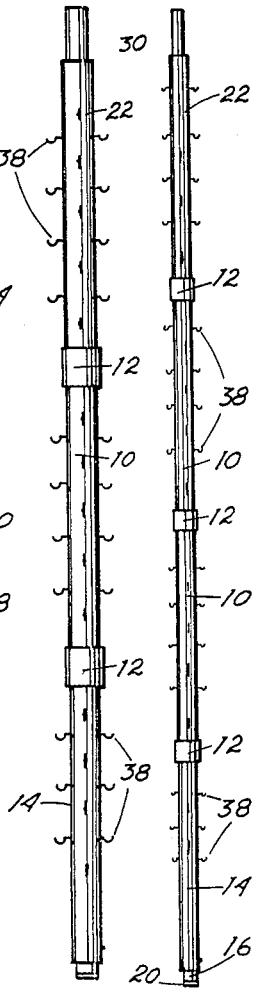
Fig. 3
Fig. 4
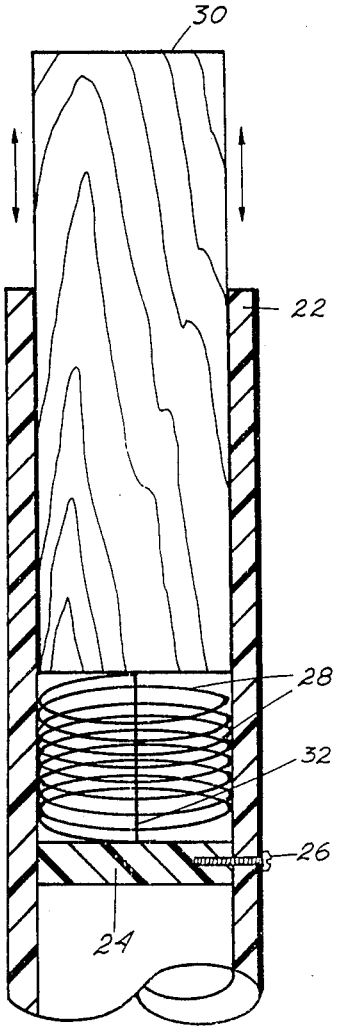
Fig. 5

ANIMAL TREE

BACKGROUND OF THE INVENTION

1. Field of the Invention

This invention relates to a sectioned, adjustable pole type device which is adapted to be self supporting between two horizontal surfaces for the purpose of storing and displaying a variety of toys.

2. Description of the Prior Art

Past art patents were examined from a search conducted in the following classes and subclasses: 248/200.1, 211/86, and 107.

The patents which follow appeared to me to be most pertinent to my invention:

A patent issued to Key on Sept. 8, 1959, U.S. Pat. No. 2,903,227, illustrates a display supporting fixture.

Palay et al was issued U.S. Pat. No. 2,941,669, on June 21, 1960, for a rotary display stand.

U.S. Pat. No. 3,035,708, dated May 22, 1962, was issued to Freeman, and discloses an adjustable stanchion.

A patent issued to Frazelle dated Jan. 30, 1962, U.S. Pat. No. 3,018,898, illustrates a portable bracket pole.

On Nov. 13, 1973, U.S. Pat. No. 3,771,665, was issued to Potter for the "Portable Pot Stand".

U.S. Pat. No. 3,820,694, issued to Pabis on June 28, 1974, illustrates a wig stand.

A patent issued to McCarthy on Jan. 17, 1978, U.S. Pat. No. 4,068,761, discloses "Apparatus For Supporting And Displaying Plants".

Craig was issued U.S. Pat. No. 4,101,036, dated Jul. 18, 1978, for "Support Column With Ceiling Thrusters".

On Jan. 22, 1980, Nicholson was issued U.S. Pat. No. 4,184,414, for an air circulation apparatus.

To my knowledge, the foregoing patents represented devices most pertinent to my invention. Although many of the support devices were similar in appearance, none appeared to have components which are capable of being dismantled into smaller sections. The main supporting structure of my invention is comprised of three to four separate tubular sections which can be easily disassembled into four shorter sections of equal size for easy storage and for easy mailing. This provides further adjustability to the device, since one or more sections can be eliminated, or additional sections added to the completed structure to decrease or increase it's height. Further adjustability is provided by the tension spring apparatus of the top telescoping dowel as well as the base dowel, having the potential to remove the bottom set screw and adjust the base dowel. My device is also devised to retain hooks for the purpose of storing and displaying children's toys, which none of the other devices appeared designed to do. My device is also available in a variety of colors to coordinate with the various differences in home interior decor. Therefore, I feel my invention has specific qualities not covered by the previously mentioned past art patents.

SUMMARY OF THE INVENTION

In utilizing my invention, I have developed a support device comprising four main separate tubular sections composed of a plastic of the PVC variety. One of the four sections is designed as the base tube for the device and contains an inserted base dowel which is adjustably affixed within the lower portion of the base tube by a bottom set screw. This base dowel is covered with a floor cap on the bottom surface which avoids damage to the floor or rug and also provides greater traction. A second tubular section of the device is designed as the top support tube and contains a telescoping, spring tensioned top dowel, which also contains a ceiling protector pad adhered to it's top surface. This top unit is designed to provide the frictional engagement to a ceiling or other horizontal surface which supports the assembled device. These three to four sections are connected together with two to three couplers, composed of like material, all of which assemble and disassemble easily. A second embodiment of the invention utilizes internal couplers and hinge retainer cords as the tension connecting means, and although it is provided as one assembled unit, it can be folded and reduced into in sections that are still connected on the ends with the hinge retainer cords. The outer surface of the assembled device contains a multiple of small hook apertures designed to receive small hooks which are designed to support a variety of stuffed toys.

Therefore, it is a primary object of my invention to provide a support device, with the character previously described, for the purpose of vertically displaying children's stuffed toys.

Another object of my invention is to provide a support device which can be vertically adjusted to provide a wide range of length within the capacity of the pole.

A further object of my invention is to provide a support device which can be easily and quickly released from operative engagement with said surfaces when required, without the aid of additional tools or apparatus.

A still further object of my invention is to provide a support device which partially disassembles easily into smaller, equally sized segments for storage and shipping.

An even further object of my invention is to provide a support device which requires no tools, or piecing together of separate parts, thereby making installation especially easy for people who have no tools or don't know how to use them. The device comes partially disassembled in a folded state, but remains connected by an inner hinge retainer cord, which requires only a minor alignment and connection of the parts.

A still further object of my invention is to provide a support device which is available in a variety of colors to coordinate with various home interior decor.

Other objects and features of the above-mentioned invention will become more apparent by reference to the following description of the embodiment of the invention in conjunction with the accompanying drawings.

BRIEF DESCRIPTION OF THE DRAWINGS

FIG. 1 shows an exploded view of the three sectioned embodiment.

FIG. 2 shows a disassembled view of the component parts of the invention.

FIG. 3 shows the three sectioned embodiment of the invention and the enlargement illustrates the internal support base structure of the lower tubular section.

FIG. 4 shows the four sectioned embodiment of the invention. FIG. 5 shows an enlarged cross section of the top support tube of the device illustrating the telescoping tension spring dowel apparatus.

DRAWING REFERENCE NUMBERS

Figure 6:
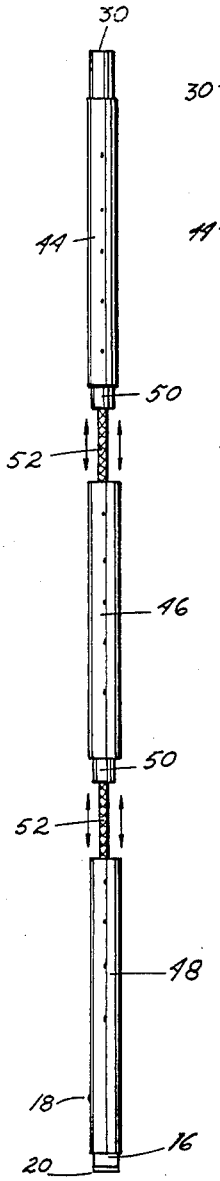
FIG. 6 is a side view of the second embodiment of the invention with the hinge retainer cord in an extended position.

10 tubular body section
12 couplers
14 base tube
16 base dowel
18 base dowel set screw
21 floor cap
22 top support tube
24 tension spring support plug
26 top set screw
28 tension spring
30 top telescoping dowel
32 top dowel restrictor cord
34 ceiling protector pad
36 hook apertures
38 hooks
40 package hooks
42 stuffed toys
44 top support tube two
46 tubular body section two
48 base tube two
50 internal coupler
52 hinge retainer cord

DESCRIPTION OF THE PREFERRED EMBODIMENT

Referring now to FIGS. 1 through 8 of the drawings, the invention is composed of one centrally located tubular body 10 connected together by couplers 12. Base tube 14 serves as the bottom support structure and is composed of a tubular section retaining a base dowel 16. Base dowel is covered on the bottom surface with floor cap 20, and is adjustably held in place with base dowel set screw 18. Top support tube 22 is connected by coupler 12 to the top of tubular body 10. Retained within top support tube 22 is tension spring support plug 24 which is releasably affixed by top set screw 26. Tension spring 28 is permanently connected to the top of tension spring support plug 24 and the bottom of top telescoping dowel 30. Running through the center of tension spring 28 is top dowel restrictor cord 32, the top of which is permanently affixed to the bottom of top telescoping dowel 30 and the bottom of which is permanently attached to the top of tension spring support plug 24. The outer surface of the device contains a multiple of hook apertures 36 designed to retain hooks 38, which are provided with the unit as packaged hooks 40. The assembled invention is designed to support stuffed toys 42 on hooks 38.

Figure 7:
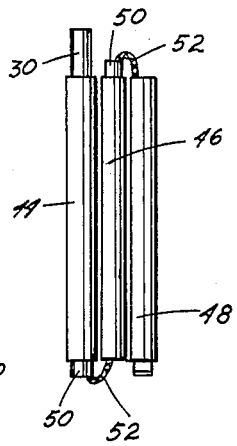
FIG. 7 shows the second embodiment of the invention in a collapsed, storage position.
Figure 8:
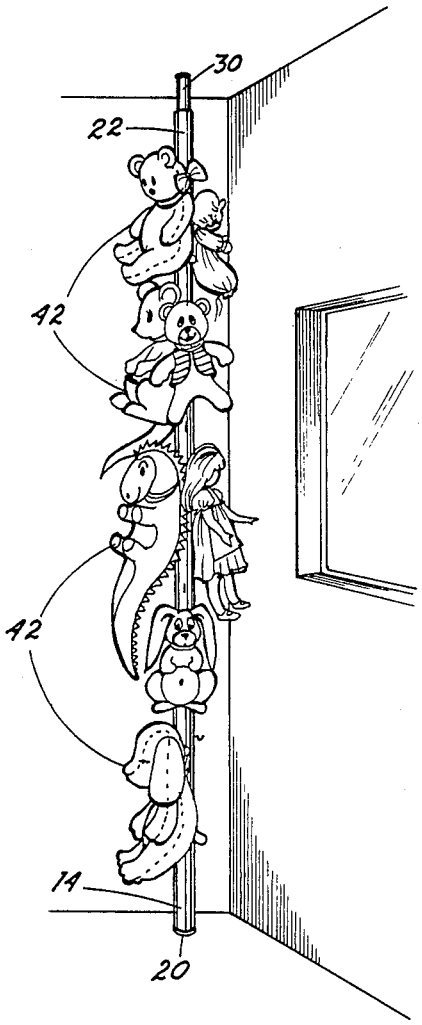
FIG. 8 shows the preferred embodiment of the invention in a perspective in use view supporting and displaying a variety of children's toys.

A second embodiment of the invention shown in FIG. 6 and 7, is comprised of top support tube two 44, tubular body section two 46 and base tube two 48, all of which have an internal coupler 50 along with a connecting hinge retainer cord 52 which serve together as a one unit, collapsible tension connecting means.

Although I have described my invention in detail in the specification, it is to be understood that modifications may be practiced which do not exceed the intended scope of the appended claims.

I claim:

1. A vertical pole hanger for children's stuffed animals and dolls comprising;

a hollow tubular pole assemblage configured of measured sections selectable to produce said assemblage vertically aligned with a first terminal end adjacent a dwelling ceiling and a second terminal end adjacent said dwelling floor, there being extended compressible means at said first terminal end and extendable adjustment means at said second terminal end to cooperatively secure said pole assemblage temporarily affixed between said ceiling and said floor of said dwelling;

means for removably attaching said measured sections to each other in continuous alignment;

means for hanging said stuffed animals and dolls to said assemblage vertically aligned.

2. The vertical pole hanger of claim 1 wherein said means for removably attaching said measured sections to each other includes short tubular couplers fitted externally to bridge the joining ends of said measured sections.

3. The vertical pole hanger of claim 1 wherein said means for removably attaching said measured sections to each other includes hollow internal couplers sized for and protruding sufficiently from one end of each said measured sections to fit supportively into the end of an adjoining said measured section releasably retained by resilience in elastic cordage aligned centrally through said hollow internal couplers and said measured sections with said elastic cordage affixed only towards said terminal ends of said hollow tubular pole assemblage.

4. The vertical pole hanger of claim 1 wherein said means for hanging said stuffed animals and dolls to said assemblage vertically aligned includes intermittently spaced apertures aligned longitudinally in said assemblage with said apertures fitted with removable hooks.

5. The vertical pole hanger of claim 1 wherein said extended compressible means at said first terminal end of said tubular pole assemblage is a cylindrical plug affixed at an upwardly terminal end with a rounded protective pad and downwardly attached slidably to a compression spring chambered in said first terminal end of said pole assemblage.

6. The vertical pole hanger of claim 1 wherein said extendable adjustment means at said second terminal end of said tubular pole assemblage is a cylindrical plug affixed at a downwardly terminal end with a rounded protective pad and upwardly inserted slidably into said second terminal end of said hollow tubular pole retained there adjustably by a set screw.

* * * * *